United States Patent [19]

Hutter, III

[11] Patent Number: 4,520,836

[45] Date of Patent: Jun. 4, 1985

[54] FREEZEPROOF VALVE ASSEMBLY

[75] Inventor: Charles G. Hutter, III, Carson City, Nev.

[73] Assignee: Physical Systems, Inc., Carson City, Nev.

[21] Appl. No.: 526,677

[22] Filed: Aug. 26, 1983

[51] Int. Cl.[3] ..... E03B 7/12; E03B 9/14

[52] U.S. Cl. ..... 137/59; 137/282; 137/301; 137/390; 137/393; 237/80; 417/182.5; 417/188

[58] Field of Search ..... 137/59, 61, 107, 281, 137/282, 301, 302, 393, 410, 434, 390; 417/182.5, 188; 237/80

[56] References Cited

U.S. PATENT DOCUMENTS

| | | | |
|---|---|---|---|
| 1,216,815 | 2/1917 | Kelly | 137/282 |
| 2,578,143 | 12/1951 | McGarry | 137/282 |
| 2,580,198 | 12/1951 | Schmid | 137/282 |
| 2,580,199 | 12/1951 | Schmid | 137/282 |
| 2,598,488 | 5/1952 | Bart | 137/282 |
| 2,598,708 | 6/1952 | McGarry et al. | 137/282 |
| 2,598,968 | 6/1952 | Boosey | 137/282 |
| 2,605,781 | 8/1952 | Schmid et al. | 137/282 |
| 2,664,096 | 12/1953 | Murdock et al. | 137/282 |
| 2,665,710 | 1/1954 | McGarry et al. | 137/282 |
| 3,017,896 | 1/1962 | Papacek | 137/282 |
| 3,534,762 | 10/1970 | Noland | 137/301 |
| 3,770,003 | 11/1973 | Uroshevich | 137/281 |
| 3,885,585 | 5/1975 | Carpenter | 137/282 |
| 4,096,877 | 6/1978 | Arledge | 137/282 |
| 4,109,671 | 8/1978 | Hughes et al. | 137/282 |
| 4,282,895 | 8/1981 | Young | 137/282 |

*Primary Examiner*—George L. Walton

*Attorney, Agent, or Firm*—Fulwider, Patton, Rieber, Lee & Utecht

[57] ABSTRACT

An improved freezeproof valve assembly is provided for a water hydrant, such as an outdoor drinking fountain or the like. The valve assembly comprises a sump housing for installation below the ground frost line and for connection between a water supply pipe and a standpipe, the latter being coupled in turn to a fountain bubbler head or the like. A control valve within the sump housing is opened pneumatically upon depression of an actuator button on the fountain to permit water flow from the supply pipe through a main jet pump which draws an induced water flow from within the sump housing through an induction port thereby providing a combined water flow through the standpipe to the bubbler head. This combined water flow is maintained substantially constant by a float-activated refill valve which permits a refill water flow from the supply pipe into the sump housing sufficient to maintain the housing water level above the main jet pump induction port. This refill water flow passes through a refill jet pump having an induction port through which a vacuum is drawn within a control line for pneumatically closing the control valve when the actuator button is released. When the control valve is closed, water within the standpipe drains through the main jet pump induction port into the sump housing.

25 Claims, 4 Drawing Figures

FREEZEPROOF VALVE ASSEMBLY

BACKGROUND OF THE INVENTION

This invention relates generally to valve devices and freeze prevention systems for use with water hydrants, such as drinking fountains, emergency showers, eye wash stations, and the like. More particularly, this invention relates to an improved freezeproof valve assembly for maintaining water flow from a fountain or the like substantially constant when the fountain is turned on but insuring positive water drainage to a freezeproof position each time the fountain is turned off.

Water hydrant valve devices are well known of the type for draining water from within the hydrant to a position where it will not freeze when the hydrant is turned off. Typically, such valve devices include an on-off valve installed below the ground frost line and operated from above the ground by an elongated rigid actuator rod to control water flow from a buried water supply pipe to a hydrant standpipe having its upper end connected, for example, to the bubbler head of an outdoor drinking fountain or the like. A pressure-responsive relief valve is commonly associated with the on-off valve to confine water flow to the standpipe when the on-off valve is opended but to permit standpipe water to drain into the surrounding soil when the on-off valve is closed, thereby preventing water from remaining within the standpipe above the ground frost line where it might otherwise freeze.

A variety of problems and disadvantages are encountered with freezeproof valve devices of the type described above. For example, the elongated valve actuator rod must be custom-fitted to the particular buried depth of the on-off valve thereby substantially increasing the cost of hydrant installation. In addition, and perhaps more importantly, drainage valve malfunction can result in water failing to drain from the standpipe thereby presenting a substantial freezing hazard when the drainage valve sticks in a closed position. Alternatively, the drainage valve can stick in an open position thereby presenting a significant danger of siphoning potentially contaminated ground water into the standpipe for flow to the foundation bubbler head. Still further, in soil areas wherein the water table is unusually high, or wherein the soil is contaminated with certain types of pollutants, the water within the standpipe may not drain satisfactorily into the surrounding soil notwithstanding proper drain valve operation.

Several freezeproof valve arrangements have been proposed wherein standpipe communication with the surrounding soil is eliminated thereby avoiding the above-discussed problems associated with drainage into the surrounding soil. In many of these arrangements, water remaining within a standpipe when an on-off valve is closed is drained into an underground sump tank isolated from the surrounding soil and ground water. When the on-off valve is subsequently opened for hydrant operation, water flow to the standpipe is directed through a jet pump or the like adapted to draw water from within the tank for flow to the standpipe, thereby partially emptying the tank to accommodate subsequent drainage thereinto of water within the standpipe when the on-off valve is closed. However, in such systems, repeated opening of the on-off valve for short time periods can result in overfilling of the sump tank to prevent standpipe water from draining into the tank. In addition, when the on-off valve is held open for an extended time period, the sump tank water level can fall below the jet pump such that the combined standpipe water flow decreases substantially and becomes a mixture of water and air. Such flow alteration is highly undesirable and is particularly annoying with drinking fountains and the like in that the height and flow rate of a water stream projected from a bubbler head can drop substantially and unexpectedly while a person is taking a drink.

There exists, therefore, a significant need for an improved valve assembly for water hydrants, such as drinking fountains and the like, which provides positive isolation from ground water and surrounding soil, which protects the hydrant against freezing, and which provides substantially constant water flow during operation. The present invention fulfills these needs and provides further related advantages.

SUMMARY OF THE INVENTION

In accordance with the invention, a freeze-proof valve assembly is provided for use with a water hydrant, such as an outdoor water drinking fountain, for draining water remaining within a standpipe to a position protected against freezing and isolated from the ground water and surrounding soil at the conclusion of each use. During operation of the hydrant, the valve assembly of the present invention maintains water flow rate through the standpipe substantially constant, irrespective of the time period of operation.

In accordance with one preferred form of the invention, the valves assembly comprises a sump housing for installation between a water supply pipe and a hydrant standpipe at a position protected against freezing, such as a buried position below the ground frost line. The housing encases a primary flow conduit coupled between the water supply pipe and the standpipe, and a refill flow conduit coupled between the water supply pipe and the interior of the sump housing. In addition, a vent line vents an upper region of the sump housing to atmosphere, and a pneumatic control line extends between the sump housing and a spring-loaded actuator button mounted at an appropriate position above the ground, such as on the frame of an outdoor drinking fountain or the like.

Depression of the actuator button releases a vacuum within the pneumatic control line to permit spring-biased movement of a control valve within the sump housing to an open position. In the open position, the control valve permits water flow from the supply line through a main jet pump along the primary flow conduit and further through the standpipe for discharge, for example, through the bubbler head of a fountain. Water flow through the main jet pump draws or induces an additional water flow from within the sump housing through a jet pump induction port and further upwardly through the standpipe. Accordingly, water flow through the standpipe to the bubbler head consists of a direct flow from the water supply pipe and an indirect or induced flow from the sump housing.

The water level within the sump housing is maintained above the main jet pump induction port during all conditions of valve assembly operation to insure substantially constant flow to the fountain bubbler head whenever the control valve is opened. More particularly, a refill valve along the refill flow conduit is opened in response to movement of a float when the water level within the sump housing reaches a predetermined lower limit. Opening of the refill valve permits water flow through the refill flow conduit until the sump housing water level reaches a predetermined upper limit whereat the float closes the refill valve.

Water refilling the sump housing flows through a refill jet pump which includes an induction port coupled through a check valve to the pneumatic control line. Accordingly, refill water flow draws a vacuum upon the control line. When the actuator button on the drinking fountain is released for spring-biased return movement closing the control line against communication to atmosphere, this vacuum drawn by the refill jet pump returns the control valve along the primary flow conduit to a closed position preventing further water flow through the main jet pump to the standpipe. When this occurs, water remaining within the standpipe drainns by gravity through the main jet pump induction port into the sump housing, with the float-controlled water level upper limit being selected to permit drainage of the standpipe water.

In accordance with further features of the invention, momentary depression of the actuator button releases the control line vacuum to initiate flow through the main jet pump to the standpipe. This standpipe flow will continue for a predetermined minimum time of at least several seconds until the float opens the refill valve to initiate refill flow thereby drawing a vacuum on the control line to close the control valve. Refill flow will continue, however, through the refill valve until the sump housing water level reaches the predetermined upper limit at which time the float closes the refill valve. Accordingly, repeated momentary depression of the actuator button will not result in sump housing overflow which could otherwise prevent standpipe drainage to pose a freezing hazard.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
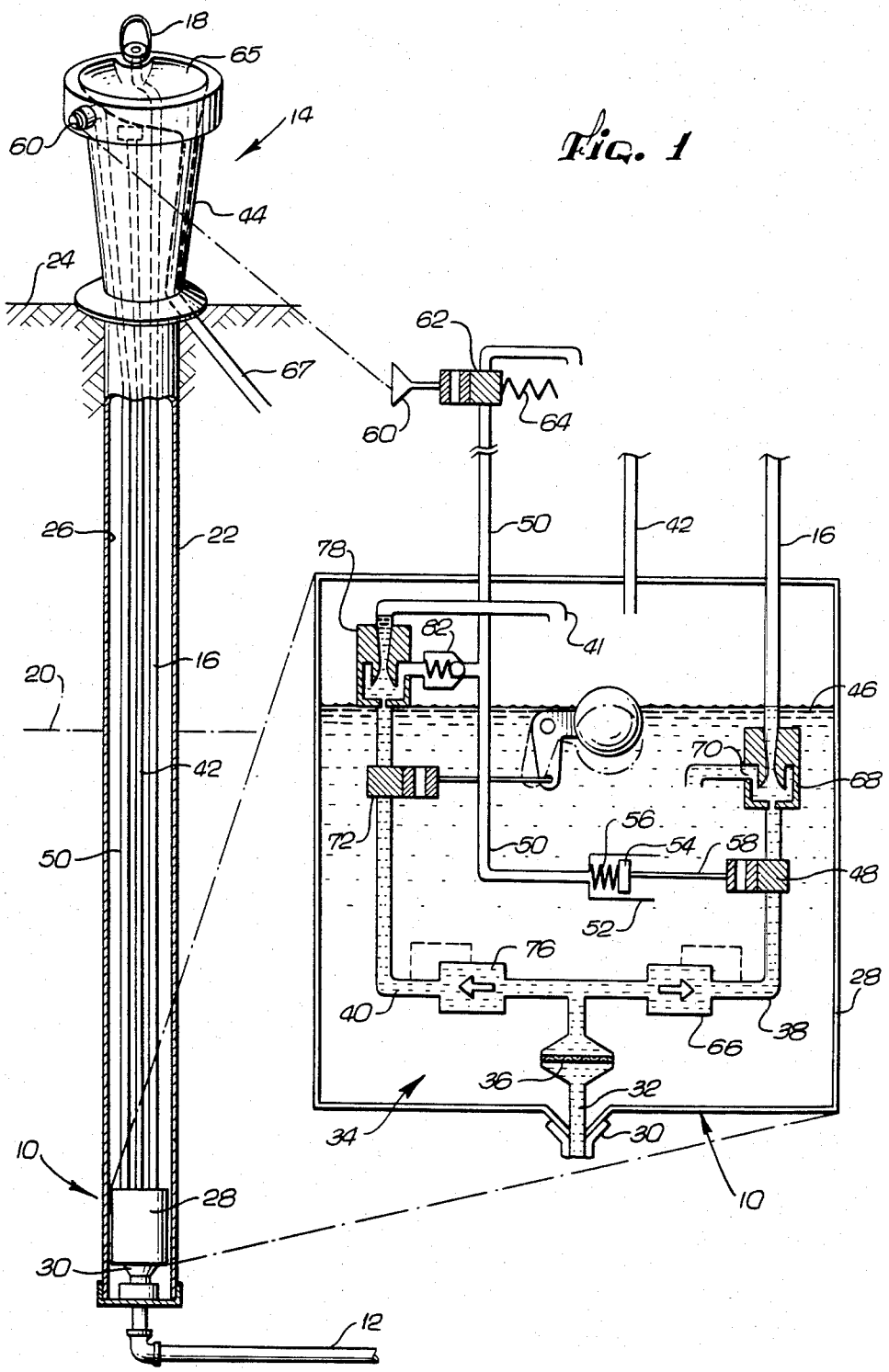
FIG. 1 is a schematic diagram illustrating a freezeproof valve assembly embodying the novel features of the present invention in conjunction with an outdoor drinking fountain, with the valve assembly being depicted in enlarged, diagrammatic form in a closed or off condition.

As shown in the exemplary drawings, a freezeproof valve assembly referred to generally by the reference numeral 10 is provided for controlling water flow from a water supply pipe 12 to a hydrant, such as an outdoor drinking fountain 14 depicted in FIG. 1. The valve assembly 10 maintains water flow to the fountain 14 substantially constant at all times during fountain operation and, when the fountain is subsequently turned off, insures positive drainage of water remaining within fountain flow lines to a position protected against freezing.

The freezeproof valve assembly 10 of the present invention provides a relatively simple, inexpensive, and highly compact self-contained unit for safeguarding a variety of different types of water hydrants, such as drinking fountains, emergency showers, eye wash stations, and the like, against freezing. The compact valve assembly unit is adapted for convenient, rapid installation between the water supply pipe 12 and a hydrant standpipe 16 which in turn has its upper end connected to an appropriate hydrant discharge outlet, such as a drinking fountain bubbler head 18, as viewed in FIG. 1. Importantly, the valve assembly 10 is positioned where it will not be subjected to subfreezing temperatures, such as at a buried position connected to the supply pipe 12 which is buried well below the ground frost line 20, as viewed in FIG. 1. Alternatively, in a drinking fountain or the like installed against an exterior wall of a building (not shown), the valve assembly 10 can be positioned inside the building where it will not be exposed to subfreezing temperatures. In either case, however, the valve assembly 10 insures positive drainage of water remaining within the standpipe, when the fountain is turned off, to a position protected against freezing and isolated from exposure to the surrounding soil and contaminants and/or ground water therein. In addition, the valve assembly advantageously permits the use of a flexible standpipe 16 as well as other conduits and lines to be described, to facilitate installation procedures and to provide broad mounting versatility permitting, for example, the fountain 14 and its bubbler head 18 to be vertically offset relative to the valve assembly 10, if desired.

In the illustrative drinking fountain embodiment shown in FIG. 1, the valve assembly 10 is adapted for installation at the bottom of a mounting tube 22 installed into the ground 24 and defining an open column 26 extending between the buried water supply pipe 12 and the drinking fountain 14. As shown in detail in the enlarged portion of FIG. 1, the valve assembly 10 comprises a generally closed valve or sump housing 28 having a cannister-like shape to include a lower inlet connector 30, such as an appropriate quick-connect coupling, for connecting an inlet end of an inlet conduit 32 with the water supply pipe 12. This inlet conduit 32 extends from the supply pipe 12 into a sump chamber 34 within the housing 28 through a conventional filter component, such as a screen strainer 36, for connection to the upstream ends of a primary flow conduit 38 and a refill flow conduit 40. The primary conduit 38 extends through the sump chamber 34 and has its downstream end appropriately joined at the top of the housing 28 to the lower end of the standpipe 16, whereas the refill conduit 40 terminates with an open end 41 for flow of water into the sump chamber 34.

The upper region of the sump chamber is vented by a vent line 42 which projects upwardly through the open tubular column 26 into the interior of the frame 44 of the water fountain 14. This vent line upper end opens to atmosphere at a concealed position protected against undesired entry of debris or particulate. The vent line permits ingress and egress of air with respect to the sump chamber 34 upon changes in the level of water 46 within the sump chamber, as will be described in more detail.

Water supply from the supply pipe 12 to the fountain bubbler head 18 is controlled by a primary control valve 48 installed along the length of the primary flow conduit 38 within the sump chamber 34. This control valve 48 is normally retained in a closed position, as viewed in FIG. 1, by a vacuum drawn within a pneumatic control line 50 having a lower end opening into a cylinder 52 such that the vacuum therein draws a piston 54 in compressive engagement with a spring 56 to correspondingly draw the control valve 48 to the closed position via a piston rod 58. The upper end of this control line 50 extends through the top of the sump housing 28 through the mounting tube 22 to an actuator button 60 on the fountain frame 44 which includes a valve member 62 biased by a spring 64 to close the control line from communication with atmosphere conveniently at a position within the frame 44 protected against undesired entry of debris or particulate into the control line.

Figure 2:
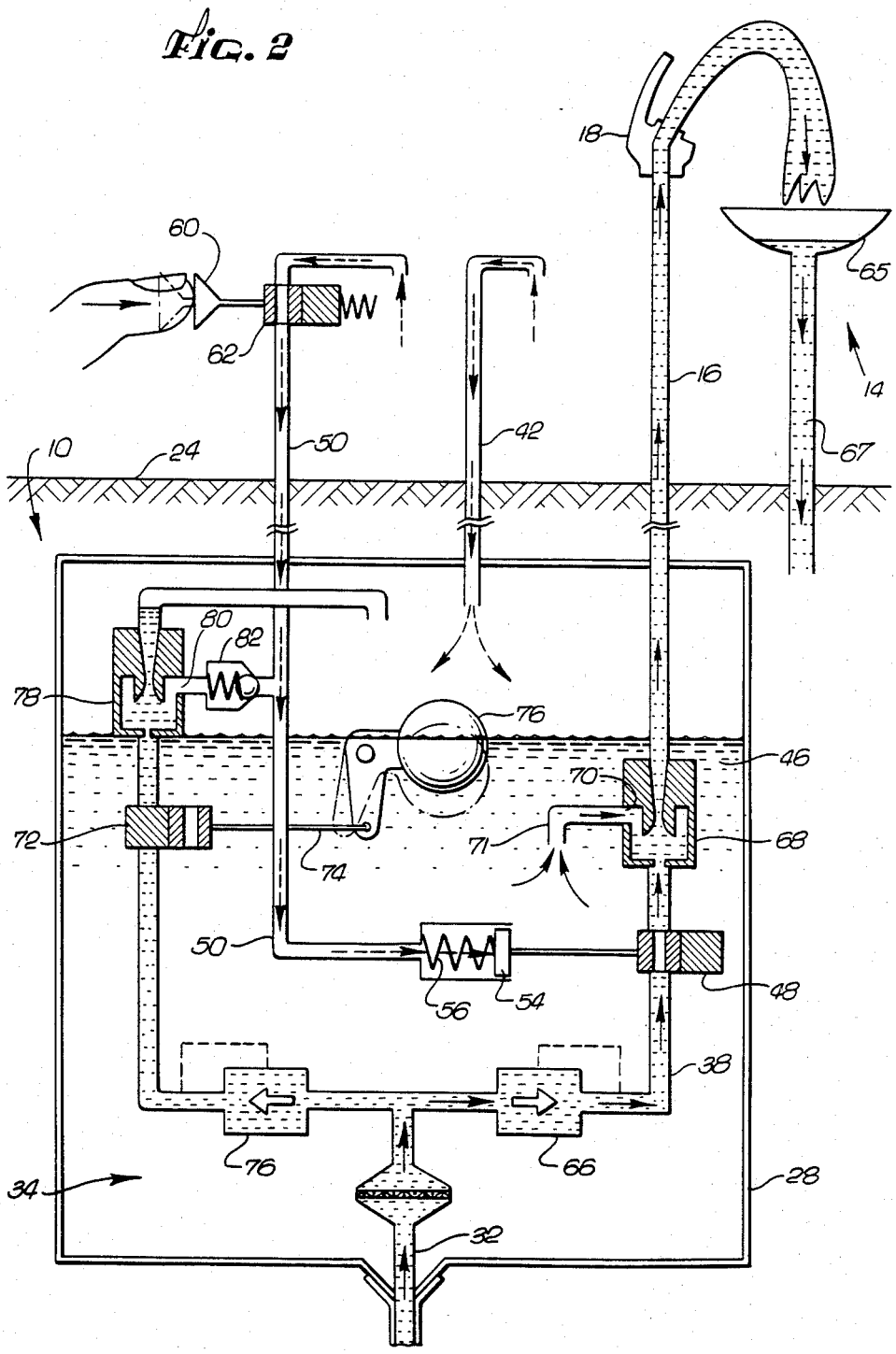
FIG. 2 is a schematic diagram illustrating the valve assembly of FIG. 1 in an initial open or on condition.

When the actuator button 60 is depressed against the spring 64, as viewed in FIG. 2, the valve member 62 is moved to an open position permitting entry of air into the control line 50 thereby releasing the vacuum therein. This vacuum release permits the control spring 56 acting against the piston 54 to shift the main control valve 48 to the open position permitting water flow through the primary conduit 38. Accordingly, water flows from the supply pipe 12 through the inlet conduit 32 and further through the primary conduit 38 and the associated control valve 48 for passage upwardly through the standpipe 16 to the fountain bubbler head 18. Conveniently, a pressure regulator valve 66 is included along the primary conduit 38 for controlling the pressure of the water discharged at the bubbler head 18, and this discharged water is directed over a conventional basin 65 having a drain line 67 through which the water is disposed in any known manner.

With the main control valve 48 in the open position, as shown in FIG. 2, water is allowed to flow through a main jet pump 68 mounted along the primary conduit 38 downstream from the control valve and within the sump chamber 34. This main jet pump includes an induction port 70 opening into the throat region of the pump wherein this induction port is associated with an intake tube 71 having an inlet end opening into the sump chamber 34 below the surface of the water 46 therein. Accordingly, water flowing upwardly through the standpipe consists of combined water flow including a direct flow from the supply pipe 12 and an indirect or induced flow drawn through the induction port 70. The flow rate of this combined flow may vary widely, of course, depending upon the type of hydrant and its application, with a flow of about 0.4 to about 0.7 gallons per minute being typical for a drinking fountain. In the preferred form of the invention, the main jet pump 68 is designed to provide this combined flow from roughly equal direct and induced flows.

Figure 3:
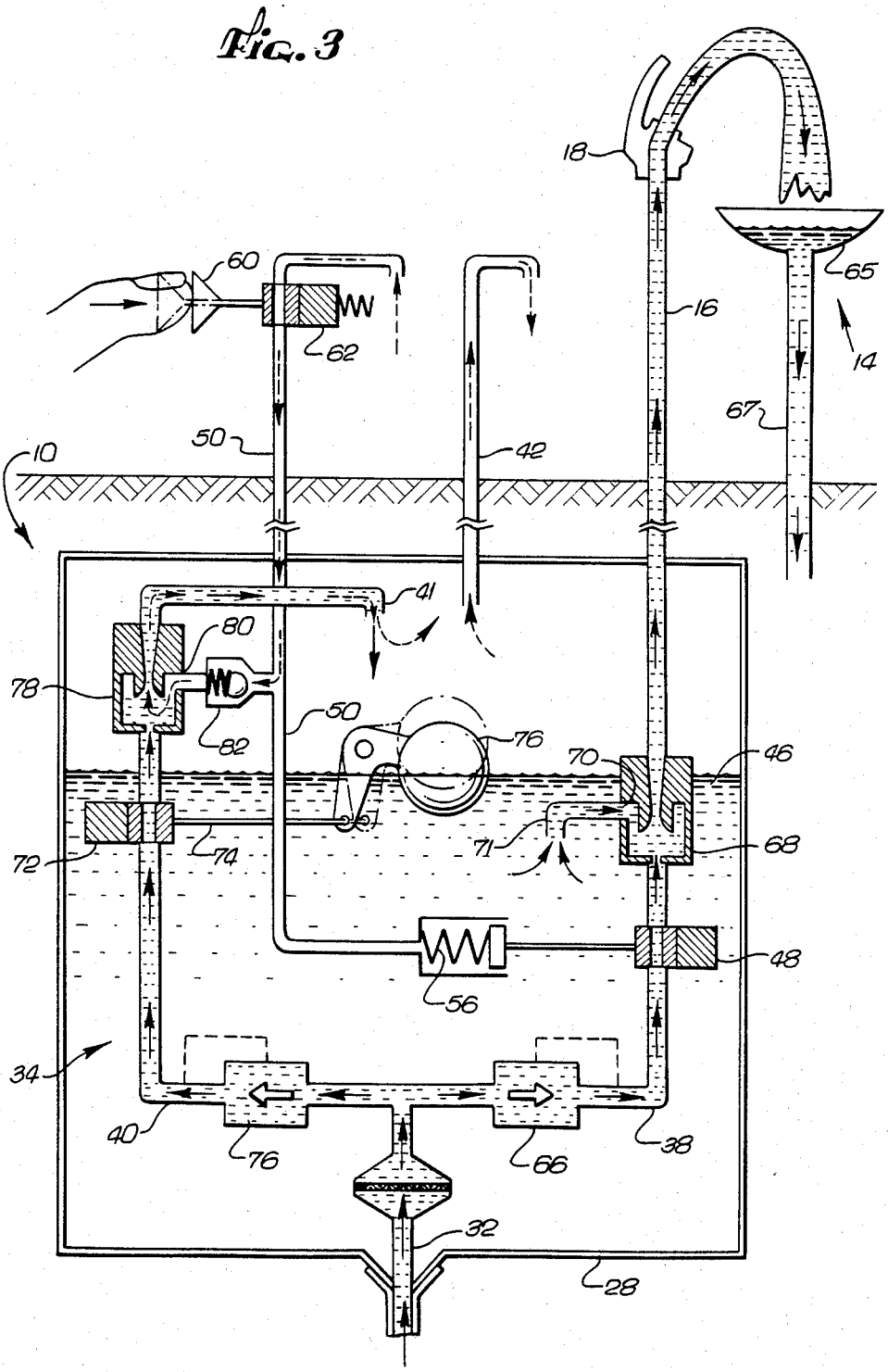
FIG. 3 is a schematic diagram illustrating the valve assembly of FIG. 1 is a subsequent open or on condition and further depicting refilling of a sump chamber.

A refill valve 72 is provided along the refill conduit 40 for maintaining water flow to the bubbler head 18 substantially constant at all times by maintaining the water level within the sump chamber 34 at least above the height of the intake tube 71 of the main jet pump 68. More particularly, the refill valve 72 is connected by a valve link 74 with a float 76 mounted pivotally within the sump chamber for response to the water level within the sump chamber to move the refill valve from a closed position, shown in FIG. 2, to an open position when the sump chamber water level falls to a predetermined lower limit, as viewed in FIG. 3.

With the refill valve 72 open, a refill water flow from the supply pipe 12 is permitted through the refill conduit 40 for discharge into and refilling of the sump chamber 34 at a flow rate greater than withdrawal through the main jet pump induction port 70. Conveniently, this refill conduit 40 includes a pressure regulating valve 76 to balance the pressures of the water flows through the primary and refill conduits 38 and 40. When the water level within the sump chamber 34 reaches a predetermined upper limit in accordance with the setting of the float 76, the float returns the refill valve 72 to the closed position, as shown in FIG. 2, irrespective of continued flow through the primary conduit 38.

The refill conduit 40 also includes a refill jet pump 78 downstream from the valve 72 through which the refill water flow passes prior to discharge into the sump chamber 34. The throat region of this jet pump 78 includes an induction port 80 coupled through a one-way inlet check valve 82 with the pneumatic control line 50. Accordingly, during refill flow, as viewed in FIG. 3, while the actuator button 60 is held in the depressed condition, the refill jet pump 78 draws air through the control line 50 for admixture with the refill water and discharge into the upper region of the sump chamber 34. Chamber pressurization is prevented, however, by the vent line 42 which vents the chamber to atmosphere, as previously described.

Figure 4:
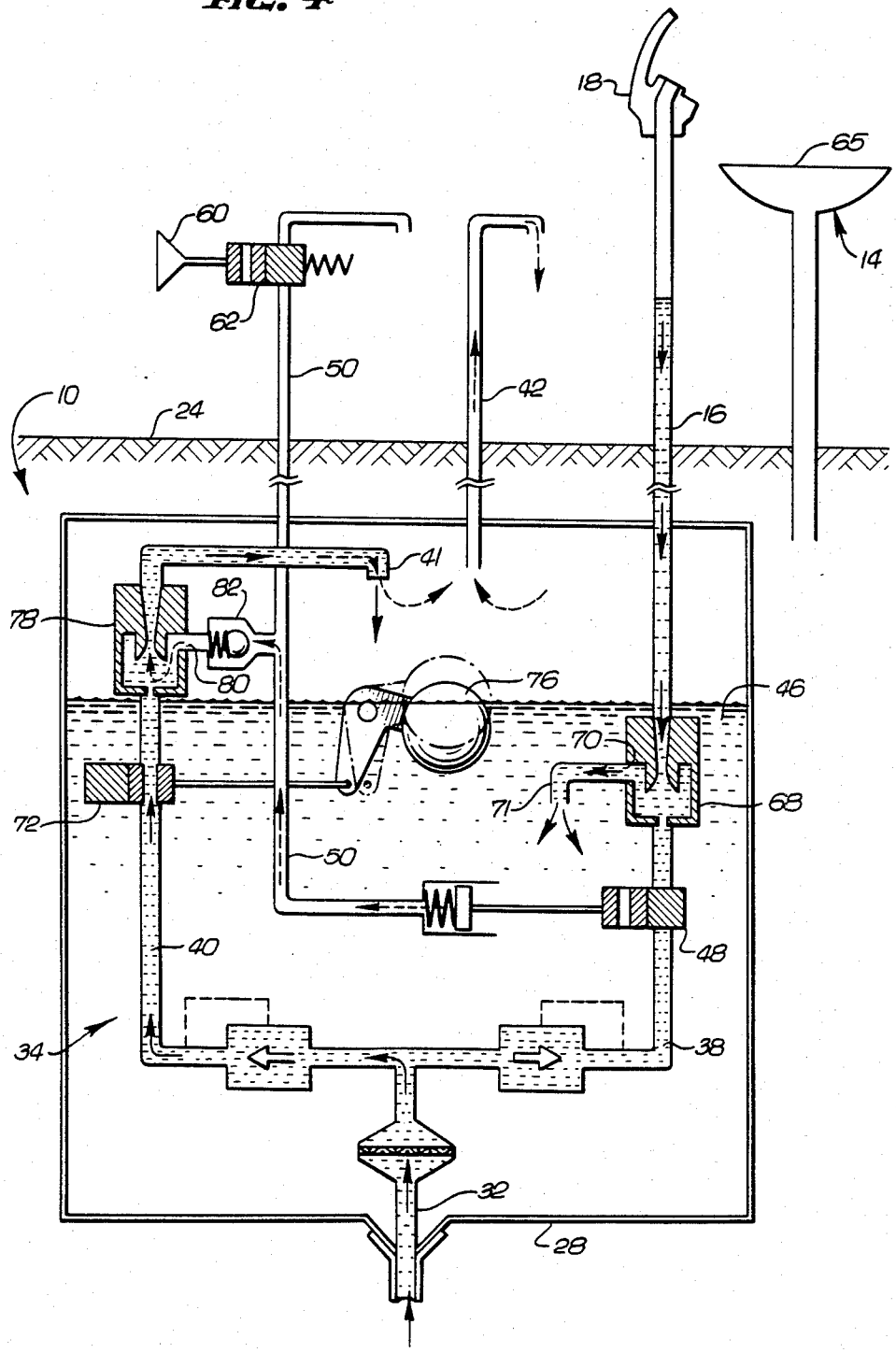
FIG. 4 is a schematic diagram illustrating standpipe water drainage into the sump chamber.

When the actuator button 60 is released, as viewed in FIG. 4, the spring-loaded actuator valve member 62 returns to the closed position to close the control line 50 from communication to atmosphere. When this occurs, the refill jet pump 78 draws a vacuum on the control line 50 for returning the primary control valve 48 to the closed position. The control valve 48 thus halts water flow through the primary conduit 38 to the standpipe 16, and water remaining within the standpipe 16 is permitted to fall by gravity downwardly to the main jet pump 68 for discharge through its induction port 70 into the sump chamber 34. Water does not remain, therefore, in the standpipe 16 at a position above the ground frost line 20 (FIG. 1) whereby the fountain is protected against freezing.

In operation, the actuator button 60 can be released at any time irrespective of the operative state of the refill valve 72 in accordance with the sump chamber water level. For example, the actuator button can be released while the refill valve 72 is open, as viewed in FIG. 4, in which case the refill jet pump 78 immediately begins drawing a vacuum on the control line 50 to close the primary control valve 48 within a few seconds. Flow to the bubbler head 18 thereupon ceases and water remaining within the standpipe drains into the sump chamber 34 as described to increase the water level within the chamber ultimately to at least the upper level float limit thereby quickly displacing the float 76 to a position closing the refill valve 72.

Alternatively, the actuator button 60 can be released when the refill valve 72 is in a closed position. In this event, drawing of a vacuum on the control line 50 by the refill jet pump 78 will be delayed until the sump chamber water level drops to a position causing float-activated opening of the refill valve 72. When the refill valve opens, the jet pump 78 draws a vacuum on the control line which becomes sufficient within a few seconds to return the control valve 48 to the closed position. The draining standpipe water and the refill water flow quickly fill the sump chamber to the predetermined upper float limit to close the refill valve 72 and standpipe drainage continues to fill the sump chamber until the standpipe water has completely drained. In this regard, the float-controlled upper water level limit is chosen in relation to total chamber volume to provide sufficient remaining chamber volume to accommodate the draining standpipe water regardless of the operational status of the valve assembly at the time the actuator button is released.

The above-described time delayed closure of the control valve 48 is particularly advantageous when the actuator button 60 is depressed momentarily and then released. Such momentary button depression opens the primary control valve 48 thereby initiating water flow to the bubbler head 18 for at least several seconds until the sump chamber level drops sufficiently for refill valve opening. Such refill valve opening, of course, draws a vacuum on the control line 50 to reclose the primary control valve 48. Accordingly, each time the actuator button is depressed even momentarily, a predetermined minimum water flow is discharged from the bubbler head and thereby also drawn from within the sump chamber 34 to prevent chamber overfilling which might otherwise occur upon repeated momentary actuator button depression.

The freezeproof valve assembly 10 of the present invention thus provides a relatively simple and compact integrated valve assembly unit for maintaining hydrant water flow substantially constant during all conditions of operation. When the hydrant is turned off, however, water from within a standpipe is drained to a position where the water will not freeze and further wherein the drained water is positively isolated from the soil and surrounding ground water. This valve operation is advantageoulsy obtained without requiring mechanical actuator rods for the valve while permitting use of flexible hydrant flow lines of plastic or the like. As a result, wide versatility in bubbler head position is available, such as, for example, mounting of the bubbler head in an overhang position for easy access by persons in wheelchairs or the like. Access and use by handicapped persons is further enhanced by the minimum flow period each time the actuator button is depressed.

A variety of modifications and improvements to the invention described herein are believed to be apparent to one of ordinary skill in the art. Accordingly, no limitation on the invention is intended, except by way of the appended claims.

What is claimed is:

1. A freezeproof valve assembly for controlling water flow from a water supply pipe to a hydrant standpipe, comprising:

a sump housing having a sump chamber for receiving a supply of water;

a primary flow conduit for connection between the water supply pipe and the standpipe;

a refill flow conduit for connection between the water supply pipe and the sump chamber;

a main jet pump along said primary flow conduit and having an induction port communicating with the sump chamber at a position below the surface level of water therein;

a control valve movable between a closed position preventing water flow through said primary flow conduit and an open position permitting a direct water flow from the supply pipe through said primary flow conduit and further through said main jet pump to draw an induced water flow through said induction port into said main jet pump thereby supplying a combined direct and induced water flow to the standpipe;

refill valve means for controlling water flow from the supply pipe through said refill flow conduit into the sump chamber to maintain the surface level of water within the sump chamber between predetermined upper and lower limits above said main jet pump induction port; and actuator means for selectively moving said control valve between said open and closed positions, said actuator means including and actuator member movable between first and second positions and a fluid coupling between said actuator member and said control valve for moving said control valve between said open and closed positions in response to actuator member movement respectively between said first and second positions;

said main jet pump induction port providing a flow path for drainage of water within the standpipe into the sump chamber when said control valve is closed.

2. The valve assembly of claim 1 wherein said sump housing is adapted for mounting in a position protected against freezing of the water within the sump chamber.

3. The valve assembly of claim 1 wherein the sump chamber is vented.

4. The valve assembly of claim 1 wherein said predetermined upper limit for the water level within the sump chamber is chosen to provide sufficient remaining chamber volume for substantial drainage reception of water within the standpipe when said control valve is closed.

5. The valve assembly of claim 1 wherein said fluid coupling comprises a pneumatic coupling.

6. A freezeproof valve assembly for controlling water flow from a water supply pipe to a hydrant standpipe, comprising:

a sump housing having a sump chamber for receiving a supply of water;

a primary flow conduit for connection between the water supply pipe and the standpipe;

a refill flow conduit for connection between the water supply pipe and the sump chamber;

a main jet pump along said primary flow conduit and having an induction port communicating with the sump chamber at a position below the surface level of water therein;

a control valve movable between a closed position preventing water flow through said primary flow conduit and an open position permitting a direct water flow from the supply pipe through said primary flow conduit and further through said main jet pump to draw an induced water flow through said induction port into said main jet pump thereby supplying a combined direct and induced water flow to the standpipe;

refill valve means for controlling water flow from the supply pipe through said refill flow conduit into the sump chamber to maintain the surface level of water within the sump chamber between predetermined upper and lower limits above said main jet pump induction port; and actuator means for selectively moving said control valve between said open and closed positions, said actuator means including a pneumatic control line, means for moving said control valve to the closed position in response to a vacuum within said control line and for moving said control valve to the open position in the absence of a vacuum within said control line, an actuator member movable between first and second positions respectively opening and closing said control line to atmosphere, and means for drawing a vacuum within said control line;

said main jet pump induction port providing a flow path for drainage of water within the standpipe into a sump chamber when said control valve is closed.

7. The valve assembly of claim 6 wherein said vacuum drawing means comprises a refill jet pump along said refill flow conduit having an induction port coupled to said control line.

8. The valve assembly of claim 7 further including a one-way check valve permitting drawing of a vacuum within said control line through said refill jet pump induction port and preventing water flow from said refill jet pump into said control line.

9. The valve assembly of claim 1 wherein said refill valve means comprises a refill valve along said refill flow conduit for selectively preventing and permitting water flow therethrough at a flow rate greater than the flow rate of said induced flow into said main jet pump, and float means for operating said refill valve.

10. The valve assembly of claim 1 wherein said control valve, said main jet pump, and said refill valve means are mounted within said sump housing.

11. The valve assembly of claim 1 including pressure regulator means for regulating the pressure of water flow through said primary and refill flow conduits.

12. A valve assembly for controlling liquid flow from a supply pipe to a standpipe, comprising:

a sump housing having a sump chamber for receiving a supply of the liquid therein;

a main jet pump coupled between the supply pipe and the standpipe and having an induction port communicating with the liquid within the sump chamber;

means for controllably supplying a direct liquid flow from the supply pipe through said main jet pump to draw an induced flow through said induction port into said main jet pump thereby supplying a combined direct and induced flow to the standpipe; and refill means for maintaining the surface level of the liquid within the sump chamber above said main jet pump induction port;

said main jet pump induction port providing a flow path for liquid drainage from the standpipe into the sump chamber upon cessation of supplying the direct flow to said main jet pump;

said supplying means including a vacuum-operated control valve, and said refill means including a refill jet pump for passage of a refill water flow into the sump chamber, said refill jet pump having a induction port for drawing a vacuum to operate said control valve.

13. The valve assembly of claim 12 wherein the sump chamber is vented.

14. A valve assembly for controlling liquid flow from a supply pipe to a standpipe, comprising:

a sump housing having a sump chamber for receiving a supply of the liquid therein;

a main jet pump coupled between the supply pipe and the standpipe and having an induction port communicating with the liquid within the sump chamber;

means for controllably supplying a direct liquid flow from the supply pipe through said main jet pump to draw an induced flow through said induction port into said main jet pump thereby supplying a combined direct and induced flow to the standpipe; and refill means for maintaining the surface level of the liquid within the sump chamber above said main jet pump induction port;

said main jet pump induction port providing a flow path for liquid drainage from the standpipe into the sump chamber upon cessation of supplying the direct flow to said main jet pump;

said supplying means including a control valve movable between an open position permitting said direct liquid flow and a closed position preventing said direct liquid flow, and further including means for maintaining said control valve in the open position for a predetermined minimum time period each time the control valve is moved to the open position.

15. A freezeproof valve assembly for controlling water flow from a water supply pipe to a standpipe, comprising:

a sump housing having a vented sump chamber for receiving a supply of water;

a main jet pump coupled between the supply pipe and the standpipe and having an induction port communicating with the sump chamber below the surface level of water therein;

a control valve movable between a closed position preventing water flow from the supply pipe to said main jet pump and an open position permitting a direct water flow from the supply pipe through said main jet pump to draw an induced water flow through said induction port thereby supplying a combined direct and induced water flow to the standpipe;

fluid actuator means for moving said control valve between the open and closed positions;

a refill valve movable between a closed position preventing water flow from the supply pipe into the sump chamber and an open position permitting a refill water flow from the supply pipe into the sump chamber at a flow rate greater than the flow rate of said induced water flow;

means for selectively opening and closing said refill valve to maintain the water level within the sump chamber above said main jet pump induction port and at a level sufficiently less than the sump chamber volume to permit a substantial portion of water within the standpipe to drain through said main jet pump induction port into the sump chamber when said control valve is in the closed position; and a refill jet pump for passage of said refill water flow, said refill jet pump having an induction port coupled with said fluid actuator means for drawing a vacuum therein for moving said control valve to the closed position.

16. The valve assembly of claim 15 wherein said fluid actuator means comprises a pneumatic control line, means for moving said control valve to the closed position in response to a vacuum within said control line and for moving said control valve to the open position in the absence of a vacuum within said control line, and an actuator member movable between first and second positions respectively opening and closing said control line to atmosphere, said refill jet pump induction port being coupled to said control valve, and a one-way check valve permitting drawing of a vaccum within said control line through said refill jet pump induction port and preventing water flow from said refill jet pump into said control line.

17. The valve assembly of claim 16 including means for biasing said actuator member toward said second position.

18. The valve assembly of claim 15 including a primary flow conduit within the sump chamber for connection between the supply pipe and the standpipe, said control valve and said main jet pump being mounted along said primary flow conduit with said control valve in an upstream position relative to said main jet pump.

19. The valve assembly of claim 18 including a refill flow conduit within the sump chamber for connection between the supply pipe and the standpipe, said refill valve and said refill jet pump being mounted along said refill conduit with said refill valve in an upstream position relative to said refill jet pump.

20. The valve assembly of claim 19 including a quick connect coupling for connecting said primary and refill flow conduits to the supply pipe.

21. A valve assembly for controlling liquid flow from a supply pipe to a standpipe, comprising:

a sump housing having a sump chamber for receiving a supply of the liquid therein;

a main jet pump coupled between the supply pipe and the standpipe and having an induction port communicating with the liquid within the sump chamber;

means for controllably supplying a direct liquid flow from the supply pipe through said main jet pump to draw an induced flow through said induction port into said main jet pump thereby supplying a combined direct and induced flow to the standpipe, said supplying means including a control valve movable between closed and open positions for respectively preventing and permitting liquid flow from the supply pipe through said main jet pump; and actuator means including an actuator member movable between first and second positions and fluid coupling means between said actuator member and said control valve for moving said control valve between said open and closed postions in response to actuator member movement respectively between said first and second positons;

said main jet pump induction port providing a flow path for liquid drainage from the standpipe into the sump chamber upon cessation of supplying the direct flow to said main jet pump.

22. The valve assembly of claim 21 wherein said fluid coupling means comprises a pneumatic coupling.

23. The valve assembly of claim 21 wherein said fluid coupling means includes means for maintaining said control valve in the open position for a predetermined minimun time period each time control valve is moved to the open position.

24. The valve assembly of claim 21 wherein said fluid coupling means comprises a pneumatic control line and means for drawing a vacuum within said control line for drawing said control valve to the closed position, said actuator member opening said control line to atmosphere when in said first position and closing said control line to atmosphere when in said second position.

25. The valve assembly of claim 24 wherein said vacuum drawing means comprises a refill jet pump for maintaining the surface level of the liquid within the sump chamber above said main jet puump induction port, said refill jet pump being for passage of a refill water flow into the sump chamber and having a refill induction port for drawing the vacuum within said control line.

* * * * *